US006769390B2

(12) United States Patent
Hattori

(10) Patent No.: US 6,769,390 B2
(45) Date of Patent: Aug. 3, 2004

(54) V-TYPE INTERNAL COMBUSTION ENGINE

(75) Inventor: Katsutaka Hattori, Saitama (JP)

(73) Assignee: Honda Giken Kogyo Kabushiki Kaisha, Tokyo (JP)

( * ) Notice: Subject to any disclaimer, the term of this patent is extended or adjusted under 35 U.S.C. 154(b) by 0 days.

(21) Appl. No.: 10/277,732

(22) Filed: Oct. 23, 2002

(65) Prior Publication Data

US 2003/0154948 A1 Aug. 21, 2003

(30) Foreign Application Priority Data

Oct. 26, 2001 (JP) ..... 2001-329938

(51) Int. Cl.[7] ..... F01P 5/12
(52) U.S. Cl. ..... 123/195 R; 123/195 C
(58) Field of Search ..... 123/54.4, 195 C, 123/195 R, 198 E

(56) References Cited

U.S. PATENT DOCUMENTS 3,851,631 A * 12/1974 Kiekhaefer ..... 123/54.4
4,399,778 A * 8/1983 Ancheta ..... 123/54.4
4,559,908 A * 12/1985 Flaig et al. ..... 123/195 R
5,009,205 A * 4/1991 Abe et al. ..... 123/198 E
5,216,984 A * 6/1993 Shimano et al. ..... 123/195 R
5,323,740 A * 6/1994 Daily et al. ..... 123/195 C
6,089,199 A * 7/2000 Lohr et al. ..... 123/198 E

* cited by examiner

*Primary Examiner*—Henry C. Yuen
*Assistant Examiner*—Jason Benton
(74) *Attorney, Agent, or Firm*—Birch, Stewart, Kolasch & Birch, LLP

(57) ABSTRACT

In a V-type internal combustion engine having a crankshaft oriented in a substantially horizontal direction, drainage channels for draining liquid such as rainwater pooling within a recess formed within the V-shaped of the engine are formed in covers for covering the end surface of the internal combustion engine in an axial direction of the crankshaft. Accordingly, liquid such as rainwater pooling on the V-shaped bank of the V-type internal combustion engine is advantageously drained from the engine with the present apparatus and methods.

20 Claims, 6 Drawing Sheets

V-TYPE INTERNAL COMBUSTION ENGINE

CROSS-REFERENCES TO RELATED APPLICATIONS

This nonprovisional application claims priority under 35 U.S.C. § 119(a) on Patent Application No. 2001-329938 filed in Japan on Oct. 26, 2001, the entirety of which is herein incorporated by reference.

BACKGROUND OF THE INVENTION

1. Field of the Invention

The present invention relates to a V-type internal combustion engine capable of draining liquid, e.g., such as rainwater pooled within a space formed in a V-shaped bank of the internal combustion engine, and more particularly to a V-type internal combustion engine having a crankshaft oriented in a substantially horizontal direction.

2. Description of the Background Art

In a V-type internal combustion engine having a crankshaft oriented in a substantially horizontal direction, e.g., for example as seen in JP-U-62-69029, the entirety of which is hereby incorporated by reference, a coolant pump is disposed on one end surface of the internal combustion engine at a position adjacent to the V-shaped bank of cylinders. Rainwater falling from above pools within the space formed in the V-bank and is difficult to removed or drained therefrom.

In the case of an internal combustion engine to be mounted on a motorcycle, when the engine is exposed to the elements and rain falls thereon, a drive unit of a dynamic valve system and a generator are disposed at the V-bank on both sides of the internal combustion engine. Accordingly, liquid such as rainwater cannot be drained and may tend to pool and eventually cause damage to the surrounding components.

SUMMARY OF THE INVENTION

The present invention overcomes the shortcomings associated with the background art and achieves other advantages not realized by the background art.

An object of the present invention is to provide a v-type internal combustion engine in which the disadvantages of the background art are overcome and/or reduced.

One or more of these and other objects are accomplished by a V-block internal combustion engine comprising a crankshaft orientated in a substantially horizontal direction; a V-block cylinder block opening upwardly with respect to the horizontal direction of the crankshaft; a V-shaped valley being formed within an upper portion of the V-block cylinder block; a cover for covering an end surface of the internal combustion engine with respect to a direction of the crankshaft; a drainage channel for draining liquid pooling in the V-shaped valley; wherein the V-shaped valley is formed in the cover.

One or more of these and other objects are further accomplished by an internal combustion engine comprising at least four cylinders and four pistons of the engine operatively engaged in a four cycle arrangement; a crankcase; a crankshaft orientated in a substantially horizontal direction; a V-block, cylinder block opening upwardly with respect to the horizontal direction of the crankshaft and being connected to an upper end surface of the crankcase; a V-shaped valley being formed within an upper portion of the V-block cylinder block; a cover for covering an end surface of the internal combustion engine with respect to a direction of the crankshaft; a drainage channel for draining liquid pooling in the V-shaped valley; wherein the V-shaped valley is formed in the cover; an oil pan connected on a lower end surface of the crankcase; a pair of left and right cylinder heads; a front cover being connected to a front face of the crankcase and V-block cylinder block; and a rear cover being connected to a rear face of the crankcase and the V-block, cylinder block.

One or more of these and other objects are further accomplished by a method of preventing a collection of water in the V-shaped valley of either of the aforementioned internal combustion engines, the method comprising the steps of draining liquid accumulating within the V-shaped valley being formed within the upper portion of the V-block cylinder block; and guiding the liquid through the drainage channel to a position external to the internal combustion engine.

Since liquid such as rainwater fallen from above to the aforementioned V-type internal combustion engine is drained out of the internal combustion engine through the V-shaped valley, the V-type internal combustion engine is prevented from rusting and/or contamination from foreign liquids and matter. Therefore, corrosion or dirt is prevented from occurring at the V-shaped bank valley of the aforementioned V-type internal combustion engine. Even when corrosion or dirt occurs in the aforementioned drainage channel, it cannot be viewed from the outside, and a desirable overall appearance is maintained.

According to additional aspects of the claimed invention discussed in greater detail hereinafter, the aforementioned drainage channel is isolated from the internal space of the internal combustion engine inwardly with the front cover. Liquid pooled in the aforementioned V-shaped bank valley and drained therefrom will never mix with engine oil or the like. Since the aforementioned drain port faces sideways and obliquely downward of the internal combustion engine, drained liquid will never flow downward along the side surface of the internal combustion engine. In addition, the drainage channel does not impair the appearance because it is provided at an indistinctive position. When the crankshaft is mounted in the direction of travel of a compact vehicle such as a motorcycle, the arrangement is even more effective because the aforementioned drain port cannot be viewed from the front.

When the aforementioned drainage channel does not require a specific member for forming the drainage channel, the number of the components can be reduced and thus the costs can be reduced. In addition, since the communication passage introducing liquid downward from the upper portion of the internal combustion engine is laid along the outlet passage of the water pump, the outlet passage of the water pump feeding coolant from the lower portion of the internal combustion engine toward the respective cylinder on the upper portion of the internal combustion engine does not interfere with the aforementioned communication passage.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinafter and the accompanying drawings which are given by way of illustration only, and thus are not limitative of the present invention, and wherein.

DETAILED DESCRIPTION OF THE PREFERRED EMBODIMENTS

Figure 1:
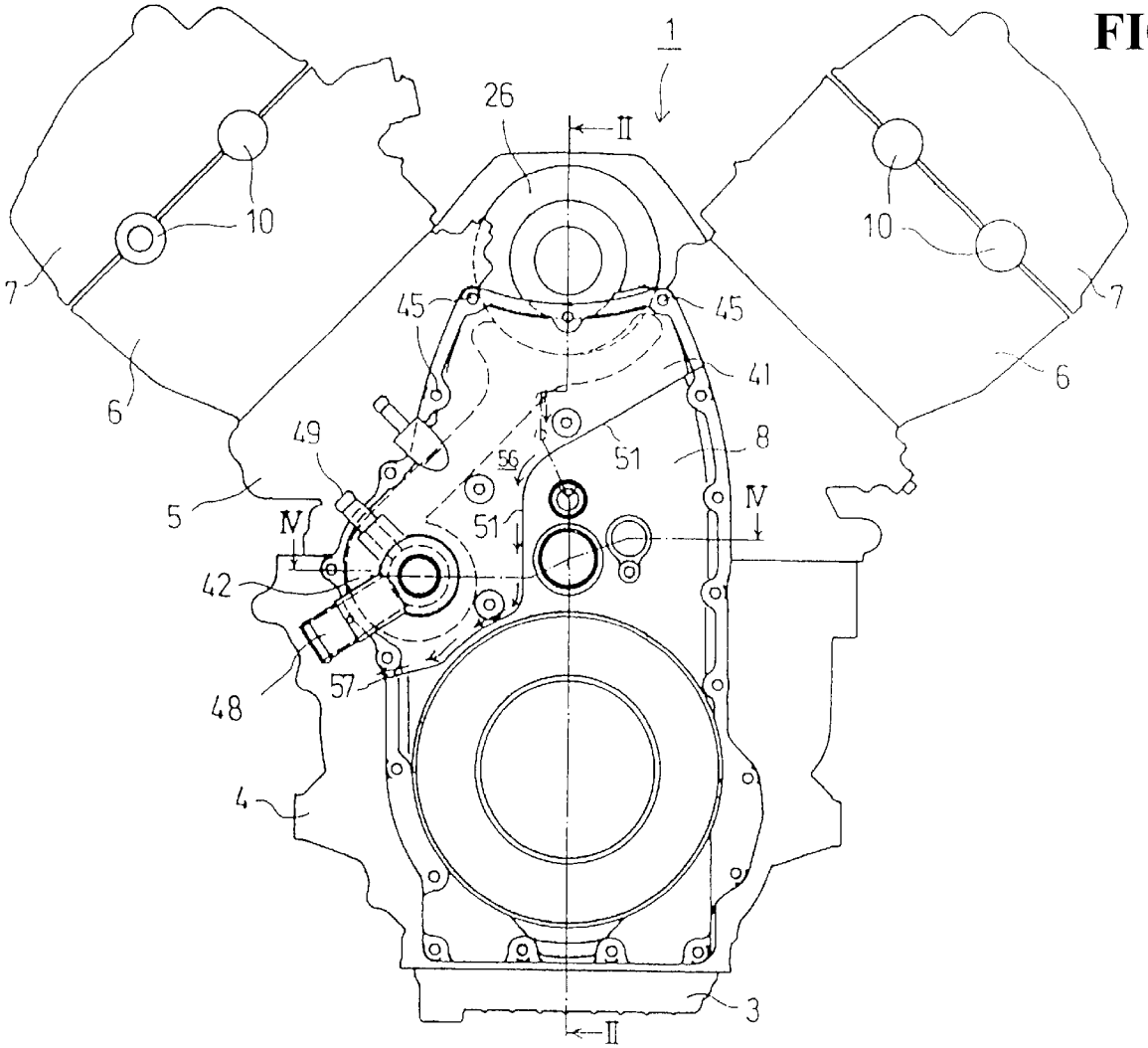
FIG. 1 is a front view of a V-type, four cylinder, four cycle internal combustion engine according to an embodiment of the present invention.
Figure 2:
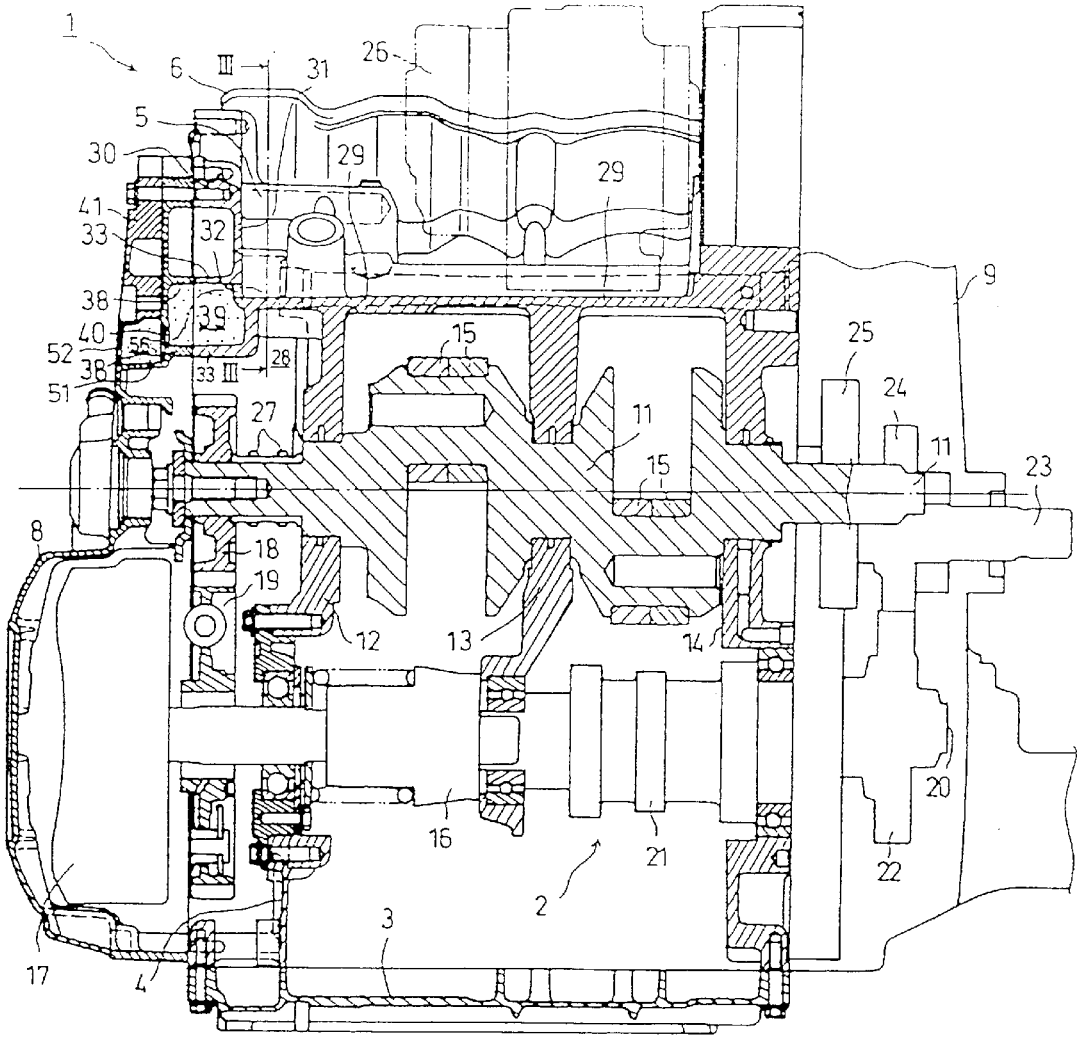
FIG. 2 is a vertical, cross sectional view taken along the line II—II in FIG. 1.
Figure 3:
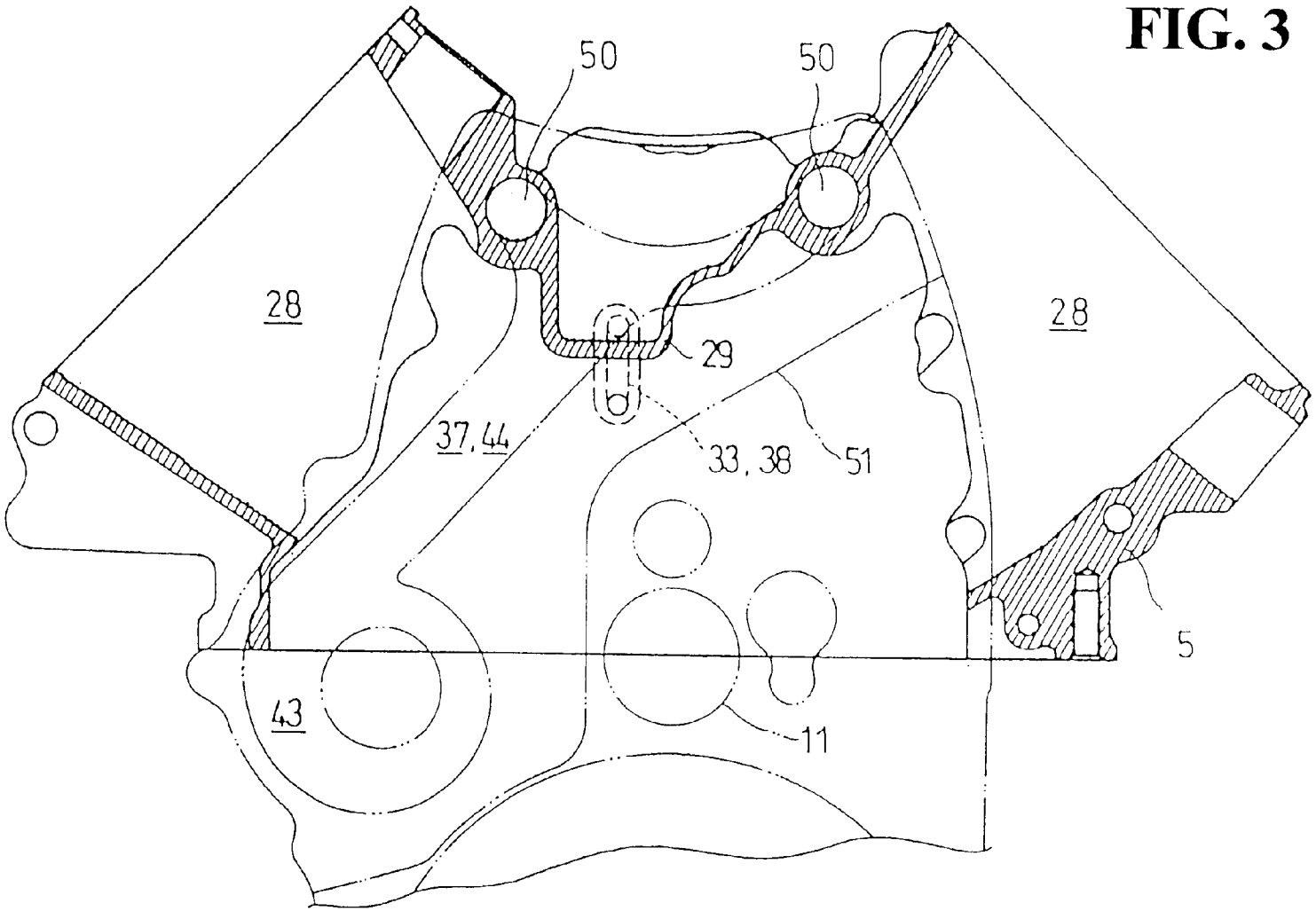
FIG. 3 is a frontal, cross sectional view taken along the line III—III in FIG. 2.
Figure 4:
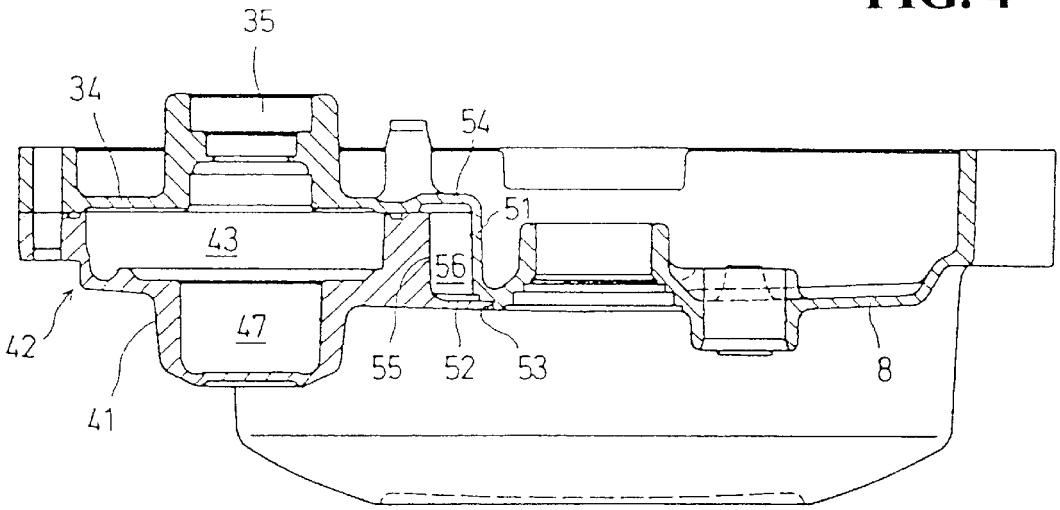
FIG. 4 is a plan, cross sectional view taken along the line IV—IV in FIG. 1.
Figure 5:
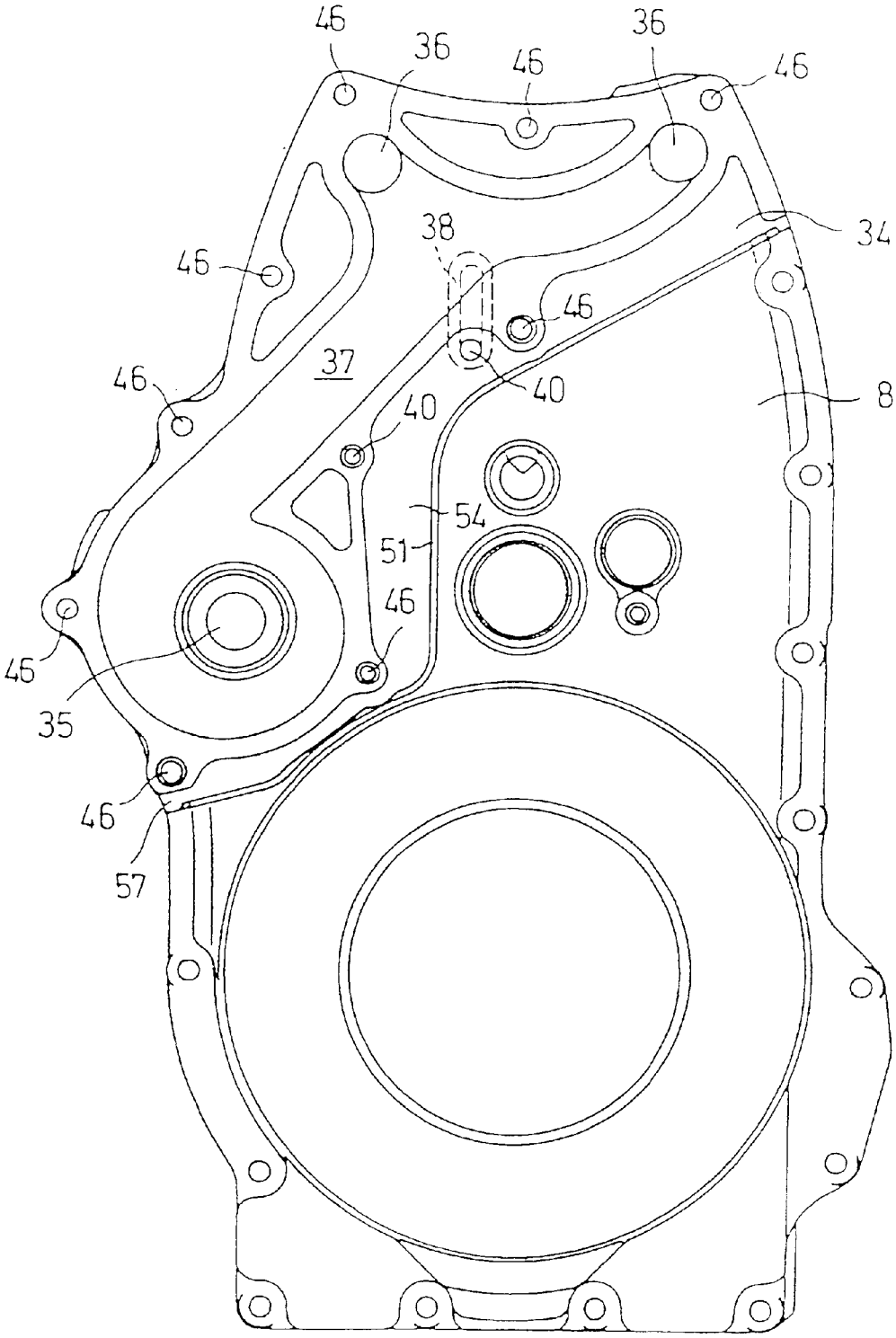
FIG. 5 is a front view of a front cover according to an embodiment of the present invention.
Figure 6:
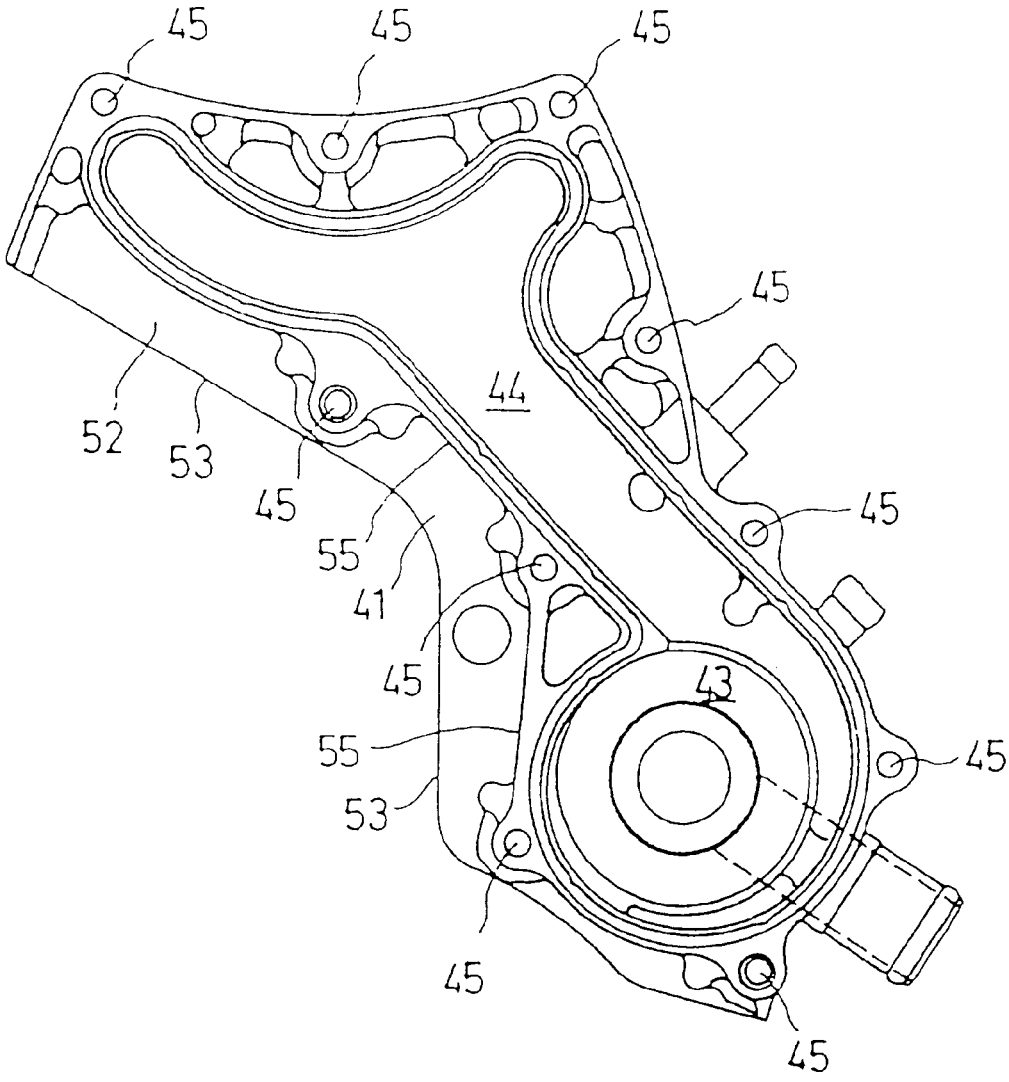
FIG. 6 is a rear view of a coolant pump cover according to an embodiment of the present invention.

The present invention will hereinafter be described with reference to the accompanying drawings. FIG. 1 is a front view of a V-type, four cylinder, four cycle internal combustion engine according to an embodiment of the present invention. FIG. 2 is a vertical, cross sectional view taken along the line II—II in FIG. 1. FIG. 3 is a frontal, cross sectional view taken along the line III—III in FIG. 2. FIG. 4 is a plan, cross sectional view taken along the line IV—IV in FIG. 1. FIG. 5 is a front view of a front cover according to an embodiment of the present invention. FIG. 6 is a rear view of a coolant pump cover according to an embodiment of the present invention. In the following discussion of the accompanying drawings, the terms "on, up and down, left and right, and front and rear" refer to directions of orientation with respect to and as viewed on the basis of the motorcycle to which an engine 1 is mounted in a preferred embodiment.

A V-type, four cylinder, four stroke (cycle) internal combustion engine 1 is mounted on a motorcycle in a preferred application of the present invention. The engine 1 includes a crankshaft 11 oriented in a fore-and-aft direction of the vehicle, e.g., a so-called vertical orientation. As shown in FIG. 2, a constant-mesh gear transmission 2 is built in a rear half of an interior of the V-type four cylinder, four stroke (cycle) internal combustion engine 1.

As shown in FIG. 1 and FIG. 2, the main body of the aforementioned V-type, four cylinder, four cycle internal combustion engine 1 includes a crankcase 4, an oil pan 3 connected on the lower end surface of the crankcase 4, a cylinder block 5 connected to the upper end surface of the crankcase 4 and including a pair of left and right cylinder banks arranged in V-shape and constructed of four cylinders (not shown). The cylinders are arranged alternately on the left and the right with respect to the direction of the axis of rotation of the aforementioned crankshaft 11. The engine 1 also includes a pair of left and right cylinder heads 6 connected respectively to the left and right cylinder banks, a pair of left and right head covers 7 connected to both of the cylinder heads 6, a front cover 8 connected to the front face of the aforementioned crankcase 4 and the cylinder block 5, and a rear cover 9 connected to the rear face of the crankcase 4 and the cylinder block 5. The front cover 8 corresponds to a first cover as discussed in the remainder of this description.

As shown in FIG. 2, a front bearing holding portion 12, an intermediate bearing holding portion 13, and a rear bearing holding portion 14 are formed by the combination of the crankcase 4 and the cylinder block 5 integrally therewith. The crankshaft 11 is rotatably supported by the bearings held by the front bearing holding portion 12, the intermediate bearing holding portion 13, and the rear bearing holding portion 14 respectively. Pistons (not shown) are slidably fitted to the aforementioned cylinders and the pistons are reciprocated by intermittent combustion of an air-fuel mixture supplied into the combustion chambers of the cylinders. The reciprocating motion of the pistons rotates the crankshaft 11 counterclockwise (clockwise when viewing the V-type, four cylinder, four stroke internal combustion engine 1 from the front) via a connecting rod 15.

The main shaft 16 is rotatably supported by the crankcase 4 at a position lower than the crankshaft 11. An output portion of the multi plate friction speed change clutch 17 is fitted on the front end portion of the main shaft 16 projected forward from the crankcase 4, a driven gear 19 is fitted on the input portion of the multi plate friction speed change clutch 17, and a drive gear 18 is formed integrally with the crankshaft 11 and engages the driven gear 19. Accordingly, a rotational torque of the crankshaft 11 is transmitted to the main shaft 16 via the multi plate friction speed change clutch 17 when the multi-plate friction speed change clutch 17 is connected.

A counter shaft 20 is rotatably supported by the crankcase 4 on the right side of the main shaft 16, a speed change gear group 21 on the main shaft side and the speed change gear group on the counter side (not shown) are provided on the main shaft 16 and the counter shaft 20 respectively. An output gear 22 on the counter shaft 20 engages the input gear 24 on the output shaft 23, so that one of the gears in the speed change gear group 21 on the main shaft side and one of the gears in the speed change gear group on the counter side are selectively engaged by the axial movement of any one of three shift forks (not shown) provided on the shift drive shaft (not shown) Power is transmitted from the main shaft 16 via the counter shaft 20 to the output shaft 23 at a prescribed change gear ratio. A drive shaft (not shown) oriented in the fore-and-aft direction is connected to the output shaft 23, and the drive shaft is connected to the rear axle of the motorcycle (not shown) via a pair of bevel gears (not shown). The rear wheel is driven by the rotation of the output shaft 23 and thus the motorcycle can travel.

Further, an AC generator drive gear 25 is integrally fitted on the rear end portion of the crankshaft 11 projected rearward from the crankcase 4 and the cylinder block 5. The AC generator drive gear 25 is connected to the input shaft of the AC generator 26 via a transmission mechanism (not shown), so that the crankshaft 11 and the AC generator 26 rotate simultaneously. The AC generator 26 is disposed at a valley, space or recess formed on the rear portion of the V-bank of the V-type, four cylinder, four stroke (cycle) internal combustion engine 1.

A drive sprocket 27 of the dynamic valve system (not shown) is disposed at the front portion of the crankshaft 11 projected forwardly from the front bearing holding portion 12 and at a position rearward of the drive gear 18. As shown in FIG. 1, a cam shaft 10 is rotatably supported at a mating surface between the cylinder head 6 and the head cover 7. An endless chain is routed between the driven sprocket that is built in the cam shaft 10 and the drive sprocket 27, so that the cam shaft 10 is rotated at half the rotational speed of the crank shaft 11 in accordance with the rotation of the crankshaft 11.

In addition, as shown in FIG. 2 and FIG. 3, the cylinder block 5 is formed with a cam chain chamber 28 in which the aforementioned endless chain can be forwarded. As shown in FIG. 3, the bottom wall 29 of the V-bank is formed in such a manner that the portion near the widthwise center of the cylinder block 5 is the lowest. As shown in FIG. 2, the front part of the bottom wall 29 of the V-bank is slightly inclined downward (when the mating surface between the crankcase 4 and the cylinder block 5 is oriented horizontally) in comparison with the rear portion of the bottom wall 29 of the V-bank and with respect to a direction of the crankshaft 11. Therefore, rainwater falling on the V-bank of the cylinder block 5 flows forward from the rear portion of the bottom wall 29 of the V-bank.

As shown in FIG. 2, a wall 31 of the cam chain chamber extending vertically downward and forming the front wall of the cam chain chamber 28 is formed integrally with the rear end of the contact portion 30 that comes into contact with the upper portion of the front cover 8. The lower portion of the wall 31 of the cam chain chamber is formed with a communication hole 32 in contact with the upper surface of the bottom wall 29 of the V-bank, and a vertically elongated cylindrical portion 33 in front view in contact with the upper portion of the communication hole 32 is formed so as to project forwardly from the wall 31 of the cam chain chamber.

As shown in FIG. 5, the front cover 8 is formed of a set back recess 34. The set back recess 34 is recessed rearward, on the upper left portion thereof from the border line extending obliquely from the position below the cylindrical portion 38 (which will be described hereinafter) toward the obliquely upper right when viewed from the front (obliquely upper left when viewed on the basis of the vehicle body). The set back recess 34 then extends vertically downward from a position slightly offset leftward and downward from the position below the aforementioned cylindrical portion 33. The recess 34 then inclines toward the obliquely lower left from a position immediately above the multi plate friction speed change clutch 17. A pump hole 35 is formed on the set back recess 34 at a lower position on the front face thereof, and coolant outlet ports 36 are formed on the set back recess 34 at the upper left and right positions thereof. Further, a shallow groove 37 is formed on the front face of the set back recess 34 so as to extend from the pump hole 35 toward the coolant outlet ports 36.

A cylindrical portion 38 having the same cross section as the vertically elongated cylindrical portion 33 projecting forward from the wall 31 of the cam chain chamber of the cylinder block 5 is provided on the upper inner surface (rear surface) of the front cover 8 so as to project toward the rear. A lead-in path 39 is defined by the cylindrical portions 33, 38, and a communication hole 40 communicating with the bottom of the cylindrical portion 38 and the outer portion of the front cover 8 is provided on the front cover 8.

A coolant pump cover 41, which corresponds to the second cover referred to hereinafter in the remainder of this description, for covering the set back recess 34 on the front cover 8 so as to be flush with the front surface of the front cover 8 is provided as shown in FIG. 6. The coolant pump cover 41 is formed with a spiral recess 43 and the coolant passage 44 of the coolant pump 42 at the position corresponding to the groove 37 of the front cover 8. The casing of the coolant pump 42 is formed by bolts to be passed through the bolt holes 45 on the coolant pump cover 41 and screwed into the bolt holes 46 on the front cover 8. A pump rotor (not shown) is inserted into and rotatably supported by the spiral recess 43 on the aforementioned coolant pump cover 41 from the front toward the rear, and the pump rotor is connected to the crankshaft 11 via a transmission mechanism such as a belt or the like, not shown.

As shown in FIG. 4, the coolant pump cover 41 is formed with a thermostat chamber 47 at the position forward of the spiral recess 43. The thermostat chamber 47 is connected with the inlet pipe joint 48 and a bypass pipe joint 49. The thermostat chamber 47 accommodates a thermostat (not shown) and the inlet pipe joint 48 is connected to the radiator (not shown) via a hose (not shown). The bypass pipe joint 49 is connected to the coolant exit (not shown) of the V-type, four cylinder, four stroke (cycle) internal combustion engine 1 via a hose (not shown). The aforementioned coolant outlet port 36 is connected to the coolant passage 50 (See FIG. 3) of the V-type, four cylinder, four stroke (cycle) internal combustion engine 1.

As shown in FIG. 4, the coolant pump cover 41 is formed in such a manner that the side edge 53 of the front plate portion 52 of the coolant pump cover 41 can be brought into intimate contact with the side wall 51 of the set back recess 34 of the front cover 8. A communication passage 56 is defined by the wall 54 and the side wall 51 of the set back recess of the front cover 8 and the front plate portion 52 and the side wall 55 of the coolant pump cover 41.

Since the embodiment shown in the figure is constructed as described above, the following operation is performed. When the V-type internal combustion engine 1 starts and the crankshaft 11 rotates, the pump rotor of the coolant pump 42 is rotated. Since the coolant is cold during startup, the thermostat (not shown) closes the water passage leading to the inlet pipe joint 48 and opens the water passage leading to the bypass pipe joint 49.

Therefore, coolant is drawn from the coolant passage 50 into the V-type internal combustion engine 1 via the hose and the bypass pipe joint 49 into the coolant passage 44 of the coolant pump 42. After being pressurized, coolant flows through the coolant passage 44 and the coolant outlet port 36 into the coolant passage 50. Accordingly, localized overheating is avoided in the V-type 4 cylinder 4 stroke cycle internal combustion engine 1 by the circulation of coolant. When coolant is heated to a value exceeding a prescribed temperature, a thermostat (not shown) is actuated, and the water passage led to the bypass pipe joint 49 is closed, and the water passage led to the inlet pipe joint 48 is opened.

Therefore, coolant heated in the engine 1 is fed to the radiator (not shown) and cooled therein. Coolant is then cooled and drawn into the spiral recess 43 of the coolant pump 42 via the hose (not shown) and the inlet pipe joint 48 and pressurized therein. Coolant then flows back to the coolant passage 50 in the engine 1 via the coolant passage 44 and the coolant outlet port 36, so that the engine 1 can be kept at proper temperatures.

When the motorcycle (not shown) travels in rain or other foul weather, and rainwater falls on the V-type, four cylinder internal combustion engine 1, rainwater pools on the bottom wall 29 of the V-bank of the engine 1. The rainwater flows forward along the bottom wall 29 of the V-bank inclined downward toward the front, and passes through the communication hole 32 on the wall 31 of the cam chain chamber. The water then flows into the lead-in path 39 defined by the cylindrical portion 33 and the cylindrical portion 38.

The lower edge 53 of the front plate portion 52 of the coolant pump cover 41 is in contact with the side wall 51 of the set back recess 34 of the front cover 8 in a watertight manner (a packing or the like may be interposed as necessary). The communication passage 56 is defined by the side wall 51 of the set back recess 34 and the wall 54 of the set back recess on the front cover 8 and the front plate portion 52 and the side wall 55 of the coolant pump cover 41. The communication passage 56 is inclined toward the lower left in front view (lower right when viewed on the basis of the vehicle body) along the side wall 51 of the set back recess 34 of the front cover 8. Accordingly, rainwater introduced into the lead-in path 39 flows through the communication hole 40 into the communication passage 55 and then flows obliquely downward in the communication passage 55. Water is then drained from the opening 57 between the lower end portion of the side wall 51 of the set back recess 34 on the front cover 8 and the peripheral wall 54 of the coolant pump 42 toward the outside of the vehicle.

Generally, when the motorcycle is traveling, rainwater drained from the opening 57 flows rearward of the vehicle body, e.g., as a mist due to wind blown while the vehicle is moving. Therefore, the water rarely adheres on the crankcase 4, the cylinder block 5, the cylinder head 6 and the body of the V-type engine 1. Accordingly, contamination of the crankcase 4, cylinder block 5, the cylinder head 6, and the like due to rain may be avoided. Since the bottom wall 29 of the V-bank inclines downward toward the front, rainwater falling on the bottom wall 29 of the V-bank does not pool on the bottom wall 29 of the V-bank, but is instead drained to the outside of the engine, even when the vehicle is stopped. In addition, since the communication passage 56 is formed along the coolant passage 44 of the coolant pump 42, the coolant passage 44 does not interfere with the communication passage 56.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A V-block internal combustion engine comprising:

a crankshaft orientated in a substantially horizontal direction;

a V-block cylinder block opening upwardly with respect to the horizontal direction of the crankshaft;

a V-shaped valley being formed within an upper portion of said V-block cylinder block;

a cover for covering an end surface of the internal combustion engine with respect to a direction of the crankshaft;

a drainage channel for draining liquid pooling in the V-shaped valley; wherein said V-shaped valley is formed in the cover.

2. The internal combustion engine according to claim 1, wherein said cover includes a first cover protecting a plurality of internal components of the internal combustion engine and extending to an end surface of an opened space in the V-shaped valley.

3. The internal combustion engine according to claim 2, further comprising a second cover for covering the first cover.

4. The internal combustion engine according to claim 2, wherein said drainage channel includes a lead-in path provided at a position facing toward a substantially lowest portion of the V-shaped valley and extending from the V-shaped bank valley to a space outwardly of said first cover.

5. The internal combustion engine according to claim 3, wherein said drainage channel includes a lead-in path provided at a position facing toward a substantially lowest portion of the V-shaped valley and extending from the V-shaped bank valley to a space outwardly of said first cover.

6. The internal combustion engine according to claim 5, further comprising a communication passage formed in a clearance between the first cover and the second cover for introducing said liquid from said lead-in path downward from the internal combustion engine.

7. The internal combustion engine according to claim 5, further comprising a drain port for draining said liquid sideways and obliquely downward from the internal combustion engine.

8. The internal combustion engine according to claim 6, further comprising a drain port for draining said liquid sideways and obliquely downward from the internal combustion engine.

9. The internal combustion engine according to claim 8, further comprising a water pump chamber, wherein said second cover is a covering member forming an outer wall portion of the water pump chamber.

10. The internal combustion engine according to claim 3, further comprising a water pump chamber, wherein said second cover is a covering member forming an outer wall portion of the water pump chamber.

11. The internal combustion engine according to claim 9, further comprising a water pump having an outlet passage, wherein said communication passage follows the outlet passage of the water pump and the communication passage is formed in a clearance between said first cover and the wall portion extending from said second cover in a direction orthogonal to the crankshaft.

12. An internal combustion engine comprising:

at least four cylinders and four pistons of said engine operatively engaged in a four cycle arrangement;

a crankcase;

a crankshaft orientated in a substantially horizontal direction;

a V-block, cylinder block opening upwardly with respect to the horizontal direction of the crankshaft and being connected to an upper end surface of the crankcase;

a V-shaped valley being formed within an upper portion of said V-block cylinder block;

a cover for covering an end surface of the internal combustion engine with respect to a direction of the crankshaft;

a drainage channel for draining liquid pooling in the V-shaped valley; wherein said V-shaped valley is formed in the cover;

an oil pan connected on a lower end surface of the crankcase;

a pair of left and right cylinder heads;

a front cover being connected to a front face of the crankcase and V-block cylinder block; and a rear cover being connected to a rear face of the crankcase and the V-block, cylinder block.

13. The internal combustion engine according to claim 12, wherein said drainage channel includes a lead-in path provided at a position facing toward a substantially lowest portion of the V-shaped valley and extending from the V-shaped bank valley to a space outwardly of said front cover.

14. The internal combustion engine according to claim 13, wherein said drainage channel includes a lead-in path provided at a position facing toward a substantially lowest portion of the V-shaped valley and extending from the V-shaped bank valley to a space outwardly of said front cover.

15. The internal combustion engine according to claim 14, further comprising a communication passage formed in a clearance between the front cover and a second cover for covering a coolant pump, said communication passage capable of introducing said liquid from said lead-in path downward from the internal combustion engine.

16. The internal combustion engine according to claim 15, further comprising a drain port for draining said liquid sideways and obliquely downward from the internal combustion engine.

17. The internal combustion engine according to claim 16, further comprising a drain port for draining said liquid sideways and obliquely downward from the internal combustion engine.

18. The internal combustion engine according to claim 17, further comprising a water pump chamber, wherein said second cover is a covering member forming an outer wall portion of the water pump chamber.

19. The internal combustion engine according to claim 18, further comprising a water pump having an outlet passage, wherein said communication passage follows the outlet passage of the water pump and the communication passage is formed in a clearance between said front cover and the wall portion extending from said second cover in a direction orthogonal to the crankshaft.

20. A method of preventing a collection of water in a V-shaped valley of the internal combustion engine, wherein said internal combustion engine is a V-block engine that includes a crankshaft orientated in a substantially horizontal direction; a V-block cylinder block opening upwardly with respect to the horizontal direction of the crankshaft;

the V-shaped valley being formed within an upper portion of said V-block cylinder block; a cover for covering an end surface of the internal combustion engine with respect to a direction of the crankshaft; a drainage channel for draining liquid pooling in the V-shaped valley; said V-shaped valley being formed in the cover, said method comprising the steps of:

draining liquid accumulating within said V-shaped valley being formed within the upper portion of said V-block cylinder block; and guiding said liquid through said drainage channel to a position external to said internal combustion engine.

* * * * *